US012590415B2

(12) United States Patent
Panzeri

(10) Patent No.: US 12,590,415 B2
(45) Date of Patent: Mar. 31, 2026

(54) IMPERMEABILIZATION TREATMENT OF PAPER OR CARDBOARD AND IMPERMEABLE PAPER OR CARDBOARD THUS OBTAINED

(71) Applicant: QWARZO S.P.A., Palazzolo Sull'Oglio (IT)

(72) Inventor: Luca Panzeri, Lomagna (IT)

(73) Assignee: QWARZO S.P.A., Palazzolo Sull'Oglio (IT)

( * ) Notice: Subject to any disclaimer, the term of this patent is extended or adjusted under 35 U.S.C. 154(b) by 0 days.

(21) Appl. No.: 18/546,112

(22) PCT Filed: Feb. 15, 2022

(86) PCT No.: PCT/EP2022/053625
§ 371 (c)(1),
(2) Date: Aug. 11, 2023

(87) PCT Pub. No.: WO2022/171893
PCT Pub. Date: Aug. 18, 2022

(65) Prior Publication Data

US 2024/0133121 A1 Apr. 25, 2024
US 2024/0229360 A9 Jul. 11, 2024

(30) Foreign Application Priority Data

Feb. 15, 2021 (IT) ..... 102021000003311

(51) Int. Cl.

| | |
|---|---|
| ***D21H 21/16*** | (2006.01) |
| ***B65D 65/42*** | (2006.01) |
| ***D21H 19/40*** | (2006.01) |
| ***D21H 19/62*** | (2006.01) |
| ***D21H 23/70*** | (2006.01) |
| ***D21H 27/10*** | (2006.01) |

(52) U.S. Cl.
CPC ..... *D21H 21/16* (2013.01); *B65D 65/42* (2013.01); *D21H 19/40* (2013.01); *D21H 19/62* (2013.01); *D21H 23/70* (2013.01); *D21H 27/10* (2013.01)

(58) Field of Classification Search
None
See application file for complete search history.

(56) References Cited

U.S. PATENT DOCUMENTS

| | | | | |
|---|---|---|---|---|
| 6,387,452 | B1 * | 5/2002 | Benayoun | B05D 1/34 427/391 |
| 6,395,338 | B1 * | 5/2002 | Benayoun | D21H 23/60 427/389.9 |
| 2013/0022827 | A1 * | 1/2013 | Imai | C09D 183/04 977/788 |
| 2014/0102651 | A1 | 4/2014 | Johnston et al. | |
| 2017/0183498 | A1 * | 6/2017 | Sperindio | C08L 83/04 |
| 2020/0230571 | A1 | 7/2020 | Kabir et al. | |
| 2020/0369833 | A1 | 11/2020 | Yang et al. | |
| 2021/0291581 | A1 * | 9/2021 | Nagpal | C08G 77/18 |
| 2022/0380633 | A1 * | 12/2022 | Weihs | C09J 7/35 |

FOREIGN PATENT DOCUMENTS

| | | | |
|---|---|---|---|
| EP | 2837736 | A1 | 2/2015 |
| JP | 10310416 | A * | 11/1998 |
| JP | 2008050380 | A * | 3/2008 |
| JP | 2013121892 | A | 6/2013 |
| KR | 20190126575 | A | 11/2019 |

OTHER PUBLICATIONS

International Search Report and Written Opinion in corresponding International Patent Application No. PCT/EP2022/053625 mailed Jun. 17, 2022. 14 pages.
International Preliminary Report on Patentability in corresponding International Patent Application No. PCT/EP2022/053625 mailed Jan. 20, 2023. 7 pages.
Response to International Search Report and Written Opinion in corresponding International Patent Application No. PCT/EP2022/053625 filed Dec. 14, 2022. 4 pages.

* cited by examiner

*Primary Examiner* — Jose I Hernandez-Kenney
(74) *Attorney, Agent, or Firm* — Leason Ellis LLP

(57) ABSTRACT

A process for the treatment of paper or cardboard surface is described that makes them impermeable to water, oil, and atmospheric gases, in particular oxygen. The invention also relates to the impermeable paper or cardboard thus obtained, which are particularly suitable for producing food product packaging or tableware.

3 Claims, 8 Drawing Sheets

IMPERMEABILIZATION TREATMENT OF PAPER OR CARDBOARD AND IMPERMEABLE PAPER OR CARDBOARD THUS OBTAINED

CROSS-REFERENCE TO RELATED PATENT APPLICATIONS

This application is a U.S. National Stage Application under 35 U.S.C. § 371 of International Patent Application No. PCT/EP2022/053625 filed Feb. 15, 2022, which claims the benefit of priority of Italian Patent Application No. 102021000003311 filed Feb. 15, 2021, both of which are incorporated by reference in their entireties. The International Application was published on Aug. 18, 2022, as International Publication No. WO 2022/171893 A1.

FIELD OF THE INVENTION

The present invention describes a method for the treatment of paper or cardboard surface that makes it impermeable to water, oil, and atmospheric gases, in particular oxygen. The invention also relates to the impermeable paper or cardboard thus obtained, which are particularly suitable for producing food products packaging or tableware, respectively.

STATE OF THE ART

A large part of food industry products is shipped and sold in containers or packaging that must be impermeable to water (or to water-based liquid phases, such as brines), liquids with an alcoholic component (for example, cocktails), oils, or gases. These characteristics are necessary both to avoid leakage of liquids or gases from the packaging, for example, in the case of carbonated drinks to prevent their degassing, or in the case of ready-to-use food containers to prevent condiments leaking; and in some cases to prevent the entry of substances from the outside, typically gases, for example moisture or oxygen that could cause food alteration and degradation; finally, impermeability (in particular to gases) is required to prevent cross exchanges between the inside and outside, in the case of products packaged in a modified atmosphere (for example, under nitrogen) where it is necessary to prevent this from being modified by the leakage of packaging gas and the simultaneous entry of atmospheric gases. Typical applications of impermeable materials are in the production of cups and straws for drinks, bags for vegetables, bags for the cold chain, packaging for long-life food, packaging for fresh food, containers for long and short-term liquids; there are also applications not related to the food industry, for example in the production of pots for floriculture.

Another class of products used in connection with food and the food industry is represented by disposable tableware (dishes, cutlery, glasses, and similar items); in this case, impermeability to liquids remains a requisite, while impermeability to gases is not strictly necessary.

Currently, a large part of food packages or disposable products for use with food is produced with various plastics, especially polyethylene terephthalate (PET, mainly used to produce bottles for beverages), polyethylene (PE), polypropylene (PP) and polystyrene (PS); in some cases, these plastics are coupled with thin metal layers, typically aluminum, to obtain airtightness, or with cardboard in Tetra Pak® packaging (registered trademark of the company with the same name).

As well known, however, the enormous amounts of plastic produced every year and not correctly disposed of represent an extremely serious environmental problem. In particular, when released into rivers, lakes and seas, they form floating islands that can trap and kill fish fauna, release secondary components having polluting effects (for example, the plasticizers used in their production), and give rise to microplastics (fragments of material smaller than 5 mm) that can be ingested by fauna ending up in the food chain up to humans. These problems are aggravated by the very long times, even hundreds of years, required for degradation of these materials.

Despite these problems, plastic wrapping and packaging, or plastic tableware, are still widely used today because, among other materials used in the food industry, glass and metals have much higher weight and costs (in addition to the risk of breakage in the case of glass), while paper does not have suitable impermeability characteristics, unless coupled with layers of different materials.

Coupling paper with a polymer layer does not overcome the drawbacks of plastics, and rather makes burdensome, if not impossible, to recycle the paper component.

Patent application JP 2008-50380 A describes a method for rendering glass or paper articles superhydrophobic. The method consists in depositing on the surface of the article to be treated with a solution containing an alcohol, a tetraalkoxysilane, hydrophobic silica fine particles, hydrochloric acid and water, and causing the composition to dry on said surface at ambient temperature in 30 minutes. This document also describes that, in order to increase durability of the superhydrophobic layer, a buffer layer may be produced on the surface of the glass or paper article before forming the superhydrophobic layer; the buffer layer is obtained by depositing on the bare surface of the article a solution containing an alkyltrialkoxysilane or a mixture of an alkyltrialkoxysilane and a tetraalkoxysilane, and drying said solution; the superhydrophobic layer described above is then produced over this buffer layer. Despite their superhydrophobic properties, the coatings of this document do not have good characteristics as to impermeability to liquids, in particular water, as demonstrated in the experimental section of the present description. Besides, the time required for drying the starting liquid composition on the surface to be coated is very long, so that the method described in this document does not lend itself to application on an industrial scale.

The object of the present invention is to provide a material having characteristics of impermeability to liquids and gases similar to those of plastics, and can therefore replace it in packaging applications, but that is easily recyclable and does not present the pollution problems associated with use of plastics. Another object of the invention is to provide a process for producing said material.

SUMMARY OF THE INVENTION

These objects are achieved according to the present invention, which in its first aspect relates to a process for treating paper or cardboard, that makes them impermeable to liquids and gases, consisting of:

A) applying to the paper or cardboard surface a treatment solution comprising:

a.1) between 35% and 100% by weight of an aqueous solution containing between 5% and 20% by weight of micrometric silica, between 15% and 40% by weight of a hydrolyzed tetraalkoxysilane, and between 25% and 40% by weight of a hydrolyzed alkyl-trialkoxysilane;

and optionally one or more further components selected from:

a.2) between 10% and 50% by weight of a C1-C6 alcohol or a mixture thereof;

a.3) a base selected from NaOH and KOH in such an amount as to control the pH in the range between 2.3 and 4.5; and a.4) between 2% and 15% by weight of glycerin dyed with a coloring agent approved for food use;

B) subjecting paper or cardboard treated with the treatment solution of step A) to a thermal treatment at a temperature between 100 and 250° C.

In its second aspect, the invention relates to the impermeable paper or cardboard obtained by the process described above.

DETAILED DESCRIPTION OF THE INVENTION

Figure 1:
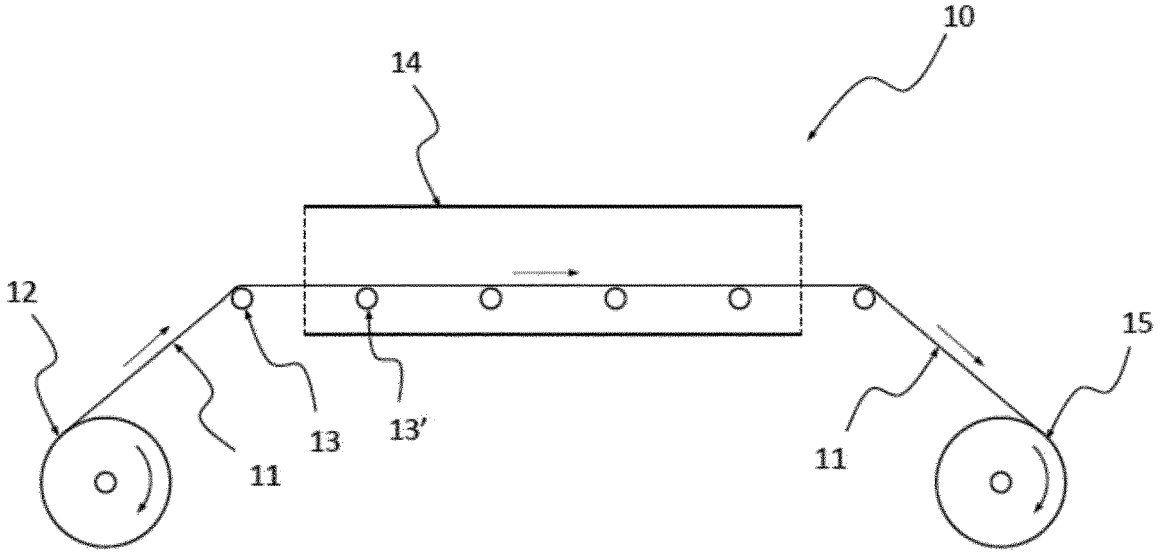
FIG. 1 schematically shows an oven for carrying out the thermal treatment of step B) of the process of the invention.

In the following description, all percentages are to be intended by weight, unless otherwise indicated.

In the first step of the invention, A), the surface of the paper or cardboard to be made impermeable is treated with a treatment solution.

The water used in the preparation of all solutions described below is demineralized water; the presence of ionic species could in fact alter the reactivity of the components used in the solutions, making the process control not reproducible.

The treatment solution may consist of the aqueous solution of point a.1 only, or it can be made therefrom with the addition of one or more of the components of points a.2-a.4.

The solution of point a.1 is an aqueous solution containing between 5 and 20% by weight of micrometric silica, between 15 and 40% by weight of a hydrolyzed tetraalkoxysilane, and between 25 and 40% by weight of a hydrolyzed alkyl-trialkoxysilane. Preferably, the amount of alkyl-trialkoxysilane in the aqueous solution is higher than that of the tetraalkoxysilane, which in this preferred condition is present in the solution in an amount varying between 15 and 25% by weight.

This solution is prepared by mixing in suitable ratios three separate solutions of the three components mentioned, which for clarity will be defined below as primary solutions.

The first of these primary solutions is a suspension containing micrometric silica. Micrometric silica is amorphous silica in the form of powders; the powders are made of primary particles of nano-sized silica (i.e., smaller than 1 micrometer, μm, typically between about 5 and 100 nm) aggregated to form micrometer-sized secondary particles, with size between about 1-100 μm. This material may be produced by combustion of vapors of silicon tetrachloride ($SiCl_4$) with oxygen in special chambers; in this case, the material is also known in the art as "pyrogenic silica" or "fumed silica". Alternatively, the silica powders may be obtained by precipitation from diluted aqueous solutions alkali metal silicate (e.g., a waterglass solution, namely a solution of sodium silicates of general formula $Na_2O{\cdot}xSiO_2$, wherein is x=2-4) with a diluted acid (e.g., sulfuric acid or hydrochloric acid); in this case the obtained amorphous silica is called in the art "precipitated silica". Given the intended use of the products of the present invention (contact with food), the micrometric silica should have a purity of not less than 99.5%; this characteristic may be checked by chemical analysis, and is intrinsically guaranteed by fumed silica obtained by combustion as described above. Micrometric silica is widely available commercially and is sold, for example, by the company Evonik Resource Efficiency GmbH, Essen (Germany) under the name AEROSIL® (for example, the product AEROSIL® OX 50), or by the company Cabot Corporation, Boston, Massachusetts (USA) under the name CabOSil®. The concentration of micrometric silica in the water-silica suspension may vary between 10% and 70%, preferably between 10 and 65%, and even more preferably between 20 and 40% by weight. To obtain a homogeneous suspension, micrometric silica is added to water under mechanical stirring, for example with an Ultra-Turrax® series mixer (manufactured and sold by the company IKA®-Werke GmbH & Co. KG, Staufen, Germany) or similar devices.

The second primary solution is an aqueous solution of a hydrolyzed tetraalkoxysilane. Tetraalkoxysilanes are compounds of general formula $Si(OR)_4$, wherein R is an alkyl radical. For the purposes of the present invention, R is a C1-C4 alkyl radical, preferably methyl, and even more preferably ethyl; the tetraalkoxysilanes corresponding to these alkyl radicals are respectively tetramethoxysilane, also known with the abbreviation TMOS, and tetraethoxysilane, also known with the abbreviation TEOS. The concentration of tetraalkoxysilane in this solution is comprised between 10 and 20% by mole; in the preferred case of using TEOS, these molar concentrations correspond to concentrations ranging from 56% to 74% by weight. Before mixing it with the other two primary solutions, the tetraalkoxysilane is hydrolyzed by bringing the solution to a basic pH, comprised between 9 and 14, and preferably between 9 and 10; preferably, this pH value is obtained by adding NaOH or KOH to the solution.

Finally, the third primary solution is an aqueous solution of a hydrolyzed alkyl-trialkoxysilane. Alkyl-trialkoxysilanes are compounds of general formula $R'—Si(OR'')_3$, where R' and R", the same or different from each other, are C1-C4 alkyl radicals; preferably R' is a C1-C3 radical, and even more preferably methyl (C1). A preferred compound for the aims of the present invention is the alkyl-trialkoxysilane wherein R'=methyl and R"=ethyl, that is the methyltriethoxysilane compound known in the field with the abbreviation MTES. The alkyl-trialkoxysilane concentration in this solution is between 30 and 50% by mole; in the preferred case of using MTES, these molar concentrations correspond to concentrations between 80% and 90% by weight. Before mixing it with the other two primary solutions, the alkyl-trialkoxysilane is hydrolyzed by bringing the solution to an acidic pH, between 1 and 3, by adding an inorganic acid, for example HCl or $HNO_3$.

Once prepared, the three primary solutions are mixed in the ratio suitable to obtain the desired composition in the ranges indicated above, i.e., between 5 and 20% by weight of micrometric silica, between 15 and 25% by weight of a hydrolyzed tetraalkoxysilane, and between 25 and 40% by weight of a hydrolyzed alkyl trialkoxysilane. Preferably, the following molar ratios are obtained in the solution thus prepared:

(tetraalkoxysilane+alkyl-trialkoxysilane)/$SiO_2$: ratio comprised between 1 and 2, even more preferably between 1.5 and 1.7;

(tetraalkoxysilane+alkyl-trialkoxysilane)/$H_2O$: ratio comprised between 0.05 and 0.1.

To the solution of point a.1, prepared as described above, it is possible to optionally add one or more of the components a.2-a.4.

Component a.2 is an alcohol with a carbon atoms number of between 1 and 6, or a mixture of these alcohols. This component, when used, may be added in amounts comprised between 10 and 50%, preferably between 15 and 30%, of the total weight of the treatment solution. The addition of component a.2 allows to speed up the drying of the treatment solution on the paper or cardboard support. Furthermore, this component allows to intervene on the viscosity of the treatment solution, which decreases as the amount of alcoholic component increases; this allows the operator to have an extra control parameter to optimize the characteristics of the product depending on the method of distribution on the paper or cardboard, or on the type of paper or cardboard (with more or less "closed" grain, i.e., with more or less closed fibers).

The component a.3 is a base selected from NaOH and KOH. This component, when present, is added to the treatment solution to increase its initial pH, normally comprised between 2.3 and 2.5, up to a maximum value of 5.5, preferably up to a value of 4.5. It is important not to exceed the value of 5.5, as this would accelerate the phenomenon of transformation of the treatment solution into a gel, thus compromising the possibility of distributing it on the paper surface. If the base is used in the form of a 1 M solution, the control of the pH within this range of values is obtained by adding the base solution in an amount between 0.20 and 0.50%, preferably between 0.30 and 0.45%, with respect to the weight of the treatment solution. Component a.3 reduces the time required for drying the treatment solution once it has been distributed on the paper or cardboard support.

Finally, component a.4 is added when it is desired to impart a color to the treatment solution (and therefore to the treated paper or cardboard obtained at the end of the process). This component consists of glycerin dyed with appropriate coloring agents, suitable for food use; in Europe, coloring agents allowed for food use are identified with an initial E #, where #is a number between 102 and 143. Glycerin to be used should have a purity degree of not less than 99.5%. This component, when present, may be added to the treatment solution in amounts comprised between 2 and 15%, preferably between 4 and 10%, depending on the color intensity to be obtained on the paper or cardboard support.

Dyed glycerin can be incorporated into the product following two operating modes. According to the first method, glycerin is added to the primary solutions of tetraalkoxysilane and alkyl-trialkoxysilane used to prepare solution a.1; the addition of glycerin to these solutions is performed before carrying out their hydrolysis; this method allows to disperse glycerin more homogeneously throughout the treatment solution. The second method consists instead in the addition of glycerin as the last step in the treatment solution preparation; in this case the mixture obtained should be stirred for at least 20 minutes, so as to allow complete dispersion of glycerin in the solution; this second method is suitable for producing treatment solutions containing low percentages of glycerin.

The treatment solution thus prepared may be distributed on the surface of the paper or cardboard to be made impermeable by various industrial techniques known in the printing field; for instance, distribution of the treatment solution on the surface of paper or cardboard can be carried out with techniques such as for example rotogravure printing, flexography, offset printing, air knife printing, inverted printing (the latter more commonly known as reverse printing) or spraying techniques.

The solution may be distributed on one or both paper or cardboard surfaces, according to the needs of the specific intended use; for instance, in case of cardboard used for producing dishes or glasses, it may be sufficient to coat the inner surface (i.e., the surface that will come into contact with food), while in case of cutlery the cardboard must be completely coated, also on its lateral surfaces. Application on both surfaces also increases the gas barrier characteristics of the product.

The thickness of the paper or cardboard coated with the solution above is not particularly limited, and depends on the intended use.

In case of paper, this may have a thickness variable between 0.03 and 0.6 mm and a weight variable between 20 and 400 $g/m^2$.

In case of cardboard for the production of tableware, this may have a thickness between 1 and 3 mm, and area weight typically between about 400 and 1400 $g/m^2$.

Papers that can be treated in the process of the invention may be kraft paper (like normal white paper), tissue paper, parchment paper, coated paper or papers coupled together to form the desired thickness. Based on the type of finished product to be obtained, the use of papers with fibers arranged more or less closely together may be evaluated; this feature determines the "closure" of the paper, which is another parameter available to the operator to check the impermeability characteristics of the final product.

The treatment of the invention is generally applied to blank paper, and mostly food papers, but excellent results have also been obtained using non-food or recycled papers. Recycled papers contain oils/fats deriving from printing inks that are almost never for food use; the inventors have observed that by using these papers in the process of the invention, in addition to obtaining the desired results of impermeability to water and oils, it is also possible to block leakage of these oils and fats contained in the paper itself towards the foods directly contacted with it.

The distribution or spreading using printing machines, according to the different technologies, allows to uniformly apply on the paper support amounts of solution between 2.5 and 30 g/m$^2$, which have proved to be useful for achieving the desired objects of the invention.

In step B) of the process of the invention, the paper or cardboard treated with the solution of step A) is subjected to a thermal treatment in one or more ovens at a temperature between 100 and 250° C., preferably between about 120 and 180° C. Even though the ignition temperature of paper is about 235° C., the thermal treatment can be carried out at a temperature up to 250° C. if its duration is short (e.g., no more than 10 seconds) thanks to the fact that heat transferred to the coated paper is initially spent in evaporation of the liquid components of the coating.

The oven or ovens may be of any type, for example closed and static ovens in which several sheets of treated paper or cardboard are placed on special trays, preferably made of metal mesh to expose both surfaces of the paper to hot air.

Preferably, however, to increase the productivity of the process, in case of paper the oven is a tunnel type one, and the paper is guided from one end to the other across its length.

This preferred configuration is shown in an extremely schematic way in FIG. 1. In the drying system 10 of the solution deposited in step A), the sheet of paper 11 is initially wound onto a roller 12, and the necessary length of paper is unwound therefrom to hook the end of it onto a second roller 15. In the system, the sheet 11 is conveyed in the direction of the arrows: the sheet 11 unwinds from the roller 12 and, moving on rotating guides 13, 13', . . . , it passes through the tunnel oven 14 and it is rewound dry downstream of this onto the roller 15. The heating means in the oven 14, not shown in the figure, may be resistors, infrared lamps, or any other useful heating means. The movement of the sheet 11 in the system 10 may be due only to the traction exerted by the roller 15; preferably, however, to avoid the risk of breaking the sheet, both rollers 12 and 15 are rotated around their axis by mechanical means, and the rotation speed of the two rollers varies during the movement of the paper in the system, under control of a differential system, to ensure that the linear unwinding speed of sheet 11 from roller 12 is always the same as the rewind speed of the sheet onto roller 15; this speed is, however, not necessarily constant throughout the process, and could be adjusted during the same according to the degree of dryness observed at the exit from the oven.

The temperature inside the oven is not necessarily constant, and it is preferable to adopt an increasing thermal profile in the oven, for example a temperature of 120° C. at the entrance to the oven and 180° C. at the exit. For an industrial production that results in sustainable product costs, the conveying speed of the paper in the system should be at least 100 m per minute; the inventors have observed that in these preferred conditions, using a tunnel oven as defined above with a thermal profile from 120 to 180° C. from inlet to outlet, the length of the oven should be at least 15 m.

In its second aspect, the invention relates to impermeable paper or cardboard obtained by the process described above.

The treated paper or cardboard has a thin layer of nanometer-thick siliceous material on its surface, which does not alter the appearance of the paper or cardboard but makes it resistant to the passage of liquids, greases, and gases.

A measure of the resistance to the passage of liquids, both water (and water-based liquid phases) and oils, is given by the hydrophobicity and oleophobicity of the treated paper or cardboard, which can be evaluated by contact angle measurements. The contact angle, indicated with the symbol $\theta_c$, is the angle defined by the tangent of the surface of a drop of liquid at the point of contact with the surface to be evaluated; this angle is measured between said tangent and the solid surface in the portion of the same in contact with the liquid. In the case of water, a surface is said to be hydrophobic, or even water-repellent, when a drop of liquid on it forms a contact angle $\theta_c$ greater than 90°; if this angle is greater than 150° the surface is called superhydrophobic. Similarly, surfaces on which oily liquids form contact angles greater than 90° are defined as oleophobic. The inventors have observed that paper or cardboard samples treated with the process of the invention are both hydrophobic and oleophobic; these characteristics prevent liquids (aqueous, oily or with an alcoholic component) from being absorbed by imbibition between the paper or cardboard fibers and thus beginning the process of crossing the paper or cardboard.

The paper or cardboard obtained with the process of the invention is therefore able to resist water and oil, and it has been observed that it also improves the barrier effect to oxygen and water vapor which, with particular types of paper, reach values very similar to those of plastic.

The invention described above will be further illustrated by the following examples.

Methods, Instruments and Materials

The products obtained were characterized by the following analyses:

- microscopy with a scanning electron microscope (SEM) to visually evaluate the paper obtained after treatment with the process of the invention; the instrument used is a LEO 1525 Zeiss SEM;
- Fourier transform infrared spectroscopy (FT-IR), for the study of the composition of the starting products and those obtained after the treatment of the invention; the instrument used is a Varian 640-IR FT-IR spectrophotometer;
- gas permeation tests, for the evaluation of gas transfer across the treated paper; the instrument used is MULTIPERM $O_2/H_2O$ sold by Permtech Srl, Pieve Fosciana (Lucca), Italy.

Example 1

This example relates to the preparation of a cardboard sample treated according to the process of the invention.

Three primary solutions of micrometric silica, a tetraalkoxysilane and an alkyl-trialkoxysilane were prepared separately.

The first primary solution was a 30% by weight solution of micrometric silica in water, obtained by adding 300 g of Evonik Resource Efficiency Aerosil® OX 50 silica to 700 ml of distilled water, and homogenizing the suspension obtained using an UltraTurrax® mixer.

The second primary solution was obtained by mixing 670 g of tetraethoxysilane (TEOS) and 330 ml of distilled water, stirring the solution with a mechanical stirrer to make it homogeneous, bringing the pH to 10 with the addition of NaOH, and allowing the system to react for 8 hours.

The third primary solution was prepared by adding 870 g of methyl-triethoxysilane (MTES) to 130 g of distilled water, stirring the solution with a mechanical stirrer to make it homogeneous, bringing the pH to 1 with the addition of HCl, and allowing the system to react for 8 hours.

The three primary solutions thus obtained were mixed, obtaining a treatment solution containing:

$SiO_2$: 10%;

TEOS: 22.3%;
MTES: 29%;
water: 38.7%.

For the purposes of carrying out the test of this Example, a cardboard was used having a thickness of 2.55 mm and a weight of 970 g/m$^2$.

A portion of the treatment solution prepared as described above was distributed with a roller system on both sides of a sample of the aforementioned cardboard having size 18×20 cm. A coating of 5 g/m$^2$ of dry product (i.e., after evaporation of water and alcohols formed during the hydrolysis of TEOS and MTES following drying treatment) was obtained.

The treated cardboard sample was dried with a thermal treatment of 3 minutes at 160° C. in a static oven (laboratory oven).

The cardboard sample thus obtained was subjected to morphological, IR and water and oil repellency characterizations.

Figure 2:
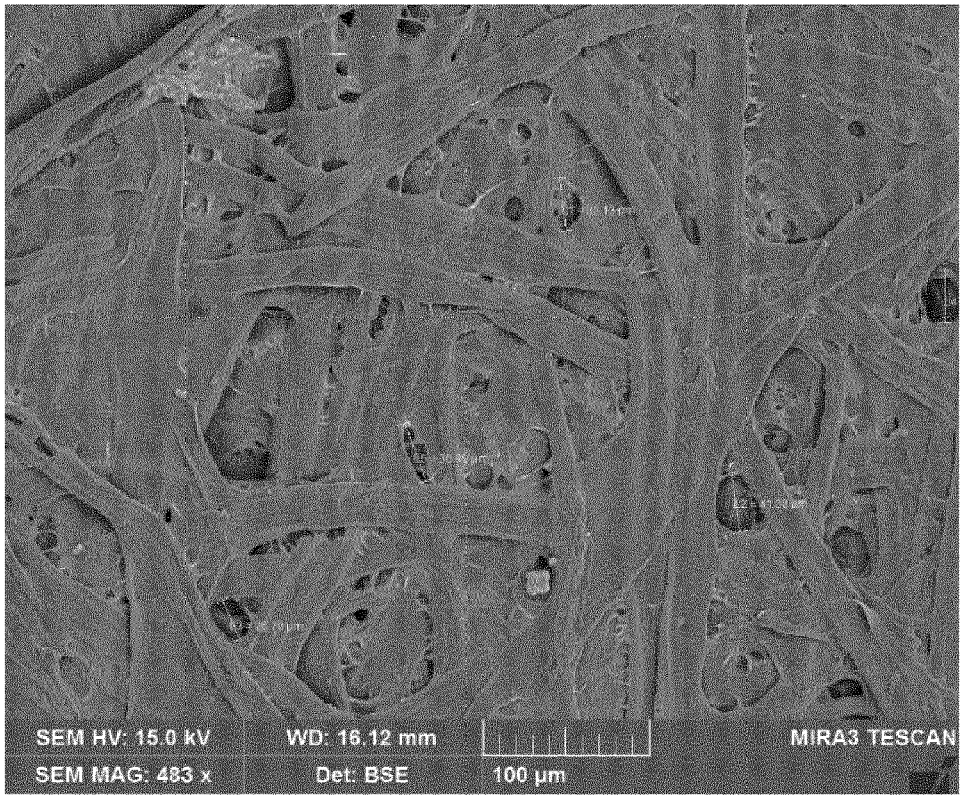
FIG. 2 shows a scanning electron microscope photograph of a paper sample obtained with the process of the invention.
Figure 3:
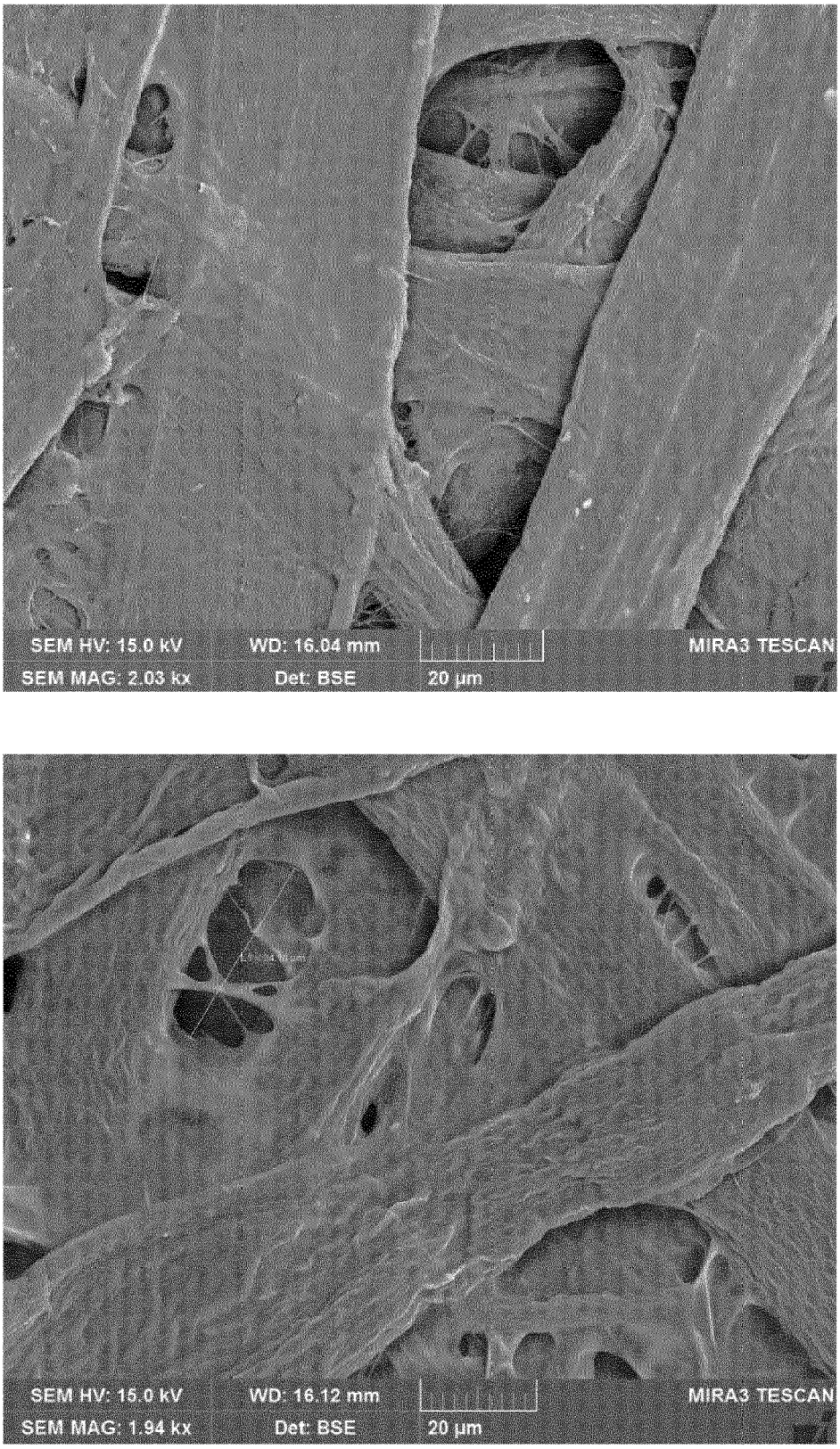
FIG. 3 shows two scanning electron microscope photographs of a paper sample obtained with the process of the invention, at a magnification greater than that of FIG. 1.

The morphological characterization was carried out by SEM analysis. The photomicrographs reported in FIG. 2, at lower magnification, and in FIG. 3, which reproduces two photomicrographs of the same sample at higher magnification, were obtained. The photomicrographs show that the openings between the cellulose fibers of the cardboard, with sizes in the order of tens of micrometers, are not completely occluded by the siliceous coating, confirming that the latter has micrometric dimensions.

Figure 4:
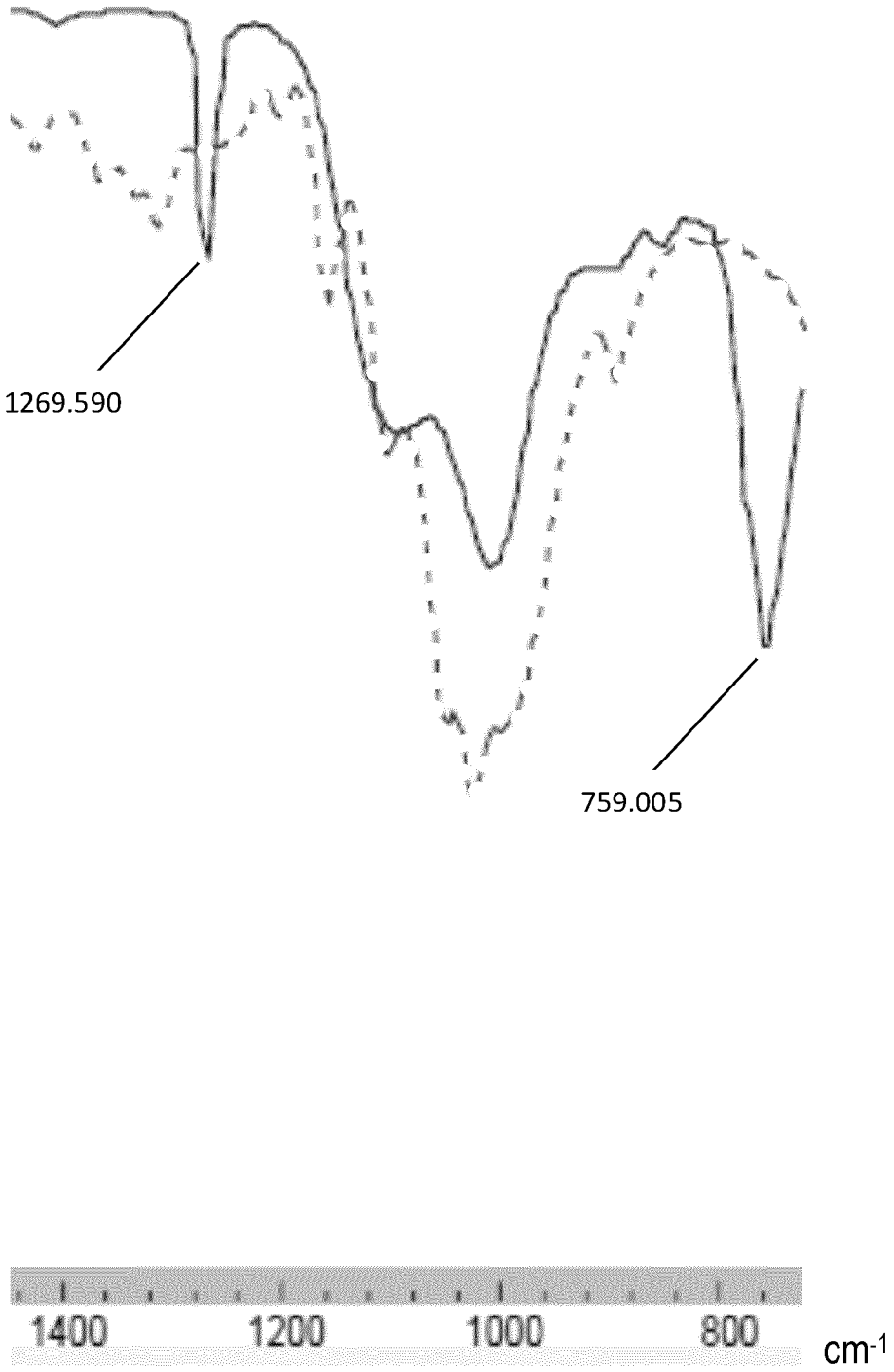
FIG. 4 shows an enlargement of the relevant part of FTIR spectra of paper and of the same paper after a coating treatment according to the invention.

FT-IR analyses were carried out on the cardboard used in Example 1, before treatment and after treatment. In FIG. 4 it is reproduced an enlargement of the relevant part, between about 720 and 1440 cm$^{-1}$, of these spectra; the dashed line refers to the untreated cardboard, the solid line to the treated cardboard. In the spectrum obtained on the sample treated according to the invention, a peak at 759.005 cm$^{-1}$ and a peak at 1269.590 cm$^{-1}$ are seen (both values assigned by the built-in software of the instrument), not present in the uncoated cardboard that, from literature data, are attributed respectively to $CH_3$ rocking and $CH_3$ symmetric bending in Si—$CH_3$ groups, while peaks in the range 1000-1100 cm$^{-1}$ attributed in the literature to the Si—O bond are superimposed to a band of the underlying cardboard.

Figure 5:
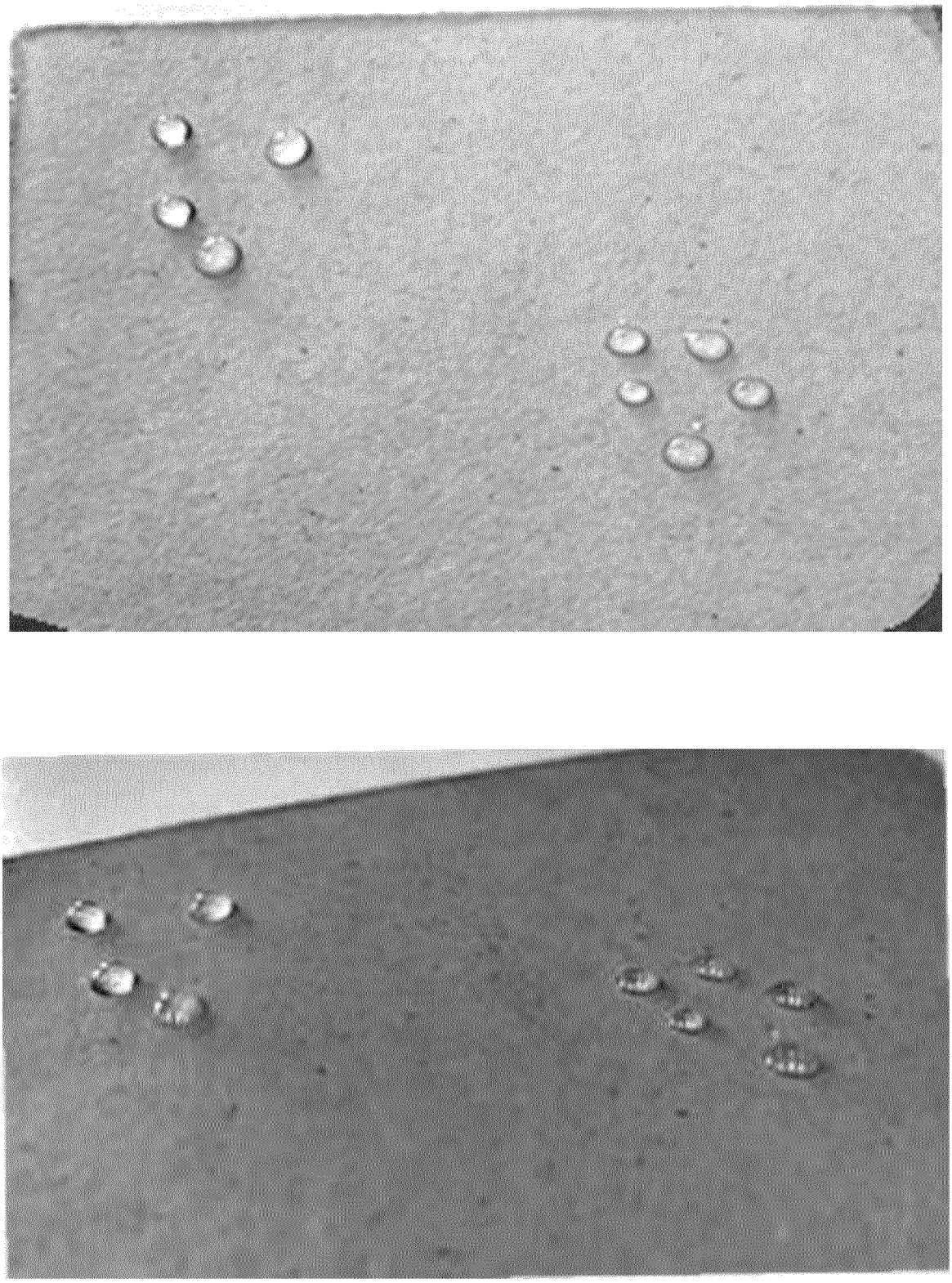
FIG. 5 reproduces two photographs, obtained at different angles, of a paper sample treated with the process of the invention, which highlight the water repellency and oil repellency properties of the sample.

FIG. 5 reproduces two photographs, obtained at different angles, of the cardboard sample obtained after the treatment of Example 1; in particular, the picture in the upper part of the figure was obtained from an angle closer to the perpendicular to the surface of the cardboard, while the picture in the lower part of the figure was obtained with a more inclined angle; in both pictures, the drops on the left are of water, while the drops on the right are of edible oil. The two photographs show that water and oil do not wet the sample, confirming the hydrophobic and oleophobic characteristics of the latter.

Example 2 (Comparative)

This example relates to the preparation of a paper sample treated according to the process of patent application JP 2008-50380 A.

A sol according to the example described in paragraph of JP 2008-50380 A was prepared, mixing the following components in the given weight percentages:

Ethanol: 96.26%;
$SiO_2$: 3%;
TEOS: 0.54%;
$H_2O$: 0.16%;
HCl: 0.04%.

Following the indications of the Japanese application, the silica used is AEROSIL® RX 300, a form of micrometric fumed silica rendered hydrophobic by treatment with HMDS (hexamethyldisilazane).

Ethanol and silica were mixed for 30 minutes, and then ultrasonically treated for another 30 minutes. To the suspension thus obtained, TEOS, $H_2O$ and HCl were then added in the amounts reported above, the mixture was stirred for 2.5 hours, and subsequently ultrasonically treated for another 30 minutes.

The resulting sol was used for coating a tissue paper of area weight 90 g/m$^2$, using a hand-operated coating roll. The sol was allowed to dry 30 minutes at room temperature.

Example 3

Example 3 was repeated, using in this case the sol of the invention prepared as described in Example 1 and drying the coated paper in air at 165° C. for 2 minutes.

Example 4 (Comparative)

This example is about the repetition of a procedure described as a second embodiment in Patent application JP 2008-50380 A.

JP 2008-50380 A also describes the possibility of applying a first (buffer) layer of a silica-based material on a substrate, followed by the layer described in comparative Example 2. Although this possibility is only exemplified in paragraph of said document on glass as a substrate, the described procedure has been repeated and applied on sticks obtained from cardboard of thickness 1.3 mm.

The buffer layer was obtained starting from a sol having the following weight percent composition:

Ethanol: 60%;
$H_2O$: 20%;
TEOS: 10.5%:
MTES: 9%:
HCl 1N: 0.5%.

The sol was prepared by first mixing ethanol, TEOS and MTES under stirring for 30 minutes, adding then water and HCl and continuing stirring for 3 hours.

Paper sticks as described above were dip coated with this sol and dried for 20 minutes at 105° C.

The pre-treated sticks thus obtained were then coated by dip coating with the sol of Example 2 and allowed to dry at room temperature for 30 minutes.

Example 5

The preparation of comparative Example 4 was repeated, using in this case the sol of the invention prepared as described in Example 1, without application of a buffer layer, and drying the coated paper sticks in air at 165° C. for 2 minutes.

Example 6

Specimens of the samples of coated paper prepared in Examples 2 and 3 were tested for hydrophobicity, by depositing a drop of water on their surface.

Figure 6:
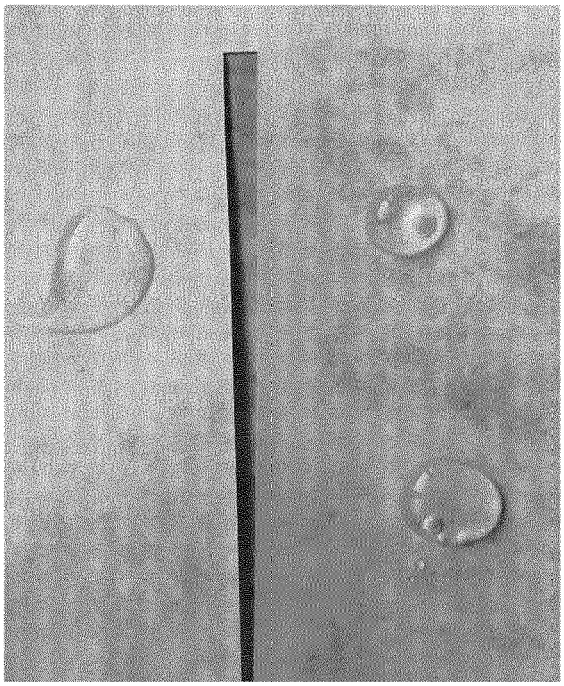
FIG. 6 reproduces a photograph of a sample of hydrophobic paper obtained according to the invention (right) and according to the prior art (left)

FIG. 6 is a photograph of the two specimens soon after the deposition of the water drops, showing the specimen of the prior art on the left and the specimen of the invention on the right.

Initially, both specimens showed hydrophobicity, even though the drop on the sample of the prior art seemed to show an increased tendency to spreading over the surface.

Figure 7:
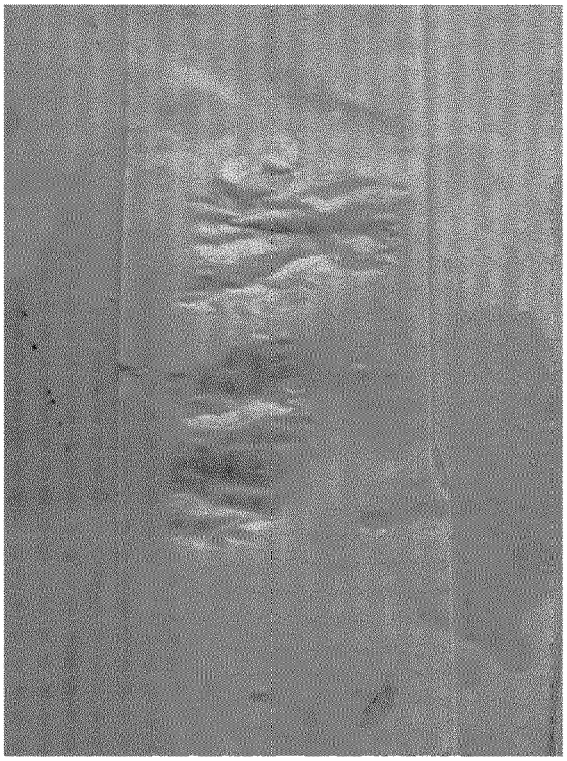
FIG. 7 reproduces a photograph showing a sample of hydrophobic paper obtained according to the prior art after 10 minutes of contact with water drops.

After 10 minutes, however, the paper specimen treated according to the present invention appeared unaltered, while the specimen treated according to JP 2008-50380 A showed ripples in correspondence of the water drop, as shown in FIG. 7, indicating that water had passed through the silica-based coating, wetting the paper.

Example 7

Specimens of the samples of coated paper prepared in Examples 2 and 3 were tested for oxygen permeation, a characteristic that is relevant in food packaging.

Table 1 shows the data obtained in the tests carried out on the two specimens specified above and, for comparison, on a sample of the starting paper used in Examples 2 and 3. The tests were carried out at 23° C., temperature kept constant throughout the tests by the thermostatic system of the instrument.

TABLE 1

| Specimen | Oxygen permeation [$cm^3/m^2$ 24 h)] |
|---|---|
| Non-treated paper | 10,935 |
| Example 2 | 10,495 |
| Example 3 | 0.049 |

The results reported in Table 1 demonstrate that the treatment of JP 2008-50380 A does not confer gas impermeability to paper, while with the treatment according to the present invention good gas impermeability is obtained, with a reduction of about 5 orders of magnitude compared to the starting paper and reaching values comparable to some paper/plastic bilayers currently available in the market.

Example 8

Specimens of the samples of coated paper prepared in Examples 4 and 5 were tested to check their resistance to liquids uptake.

Paper sticks of cardboard of relatively high thickness of this kind are typically used for stirring beverages (e.g., coffee or tea from vending machines), so they must be capable to resist soaking at least for a few minutes.

Figure 8:
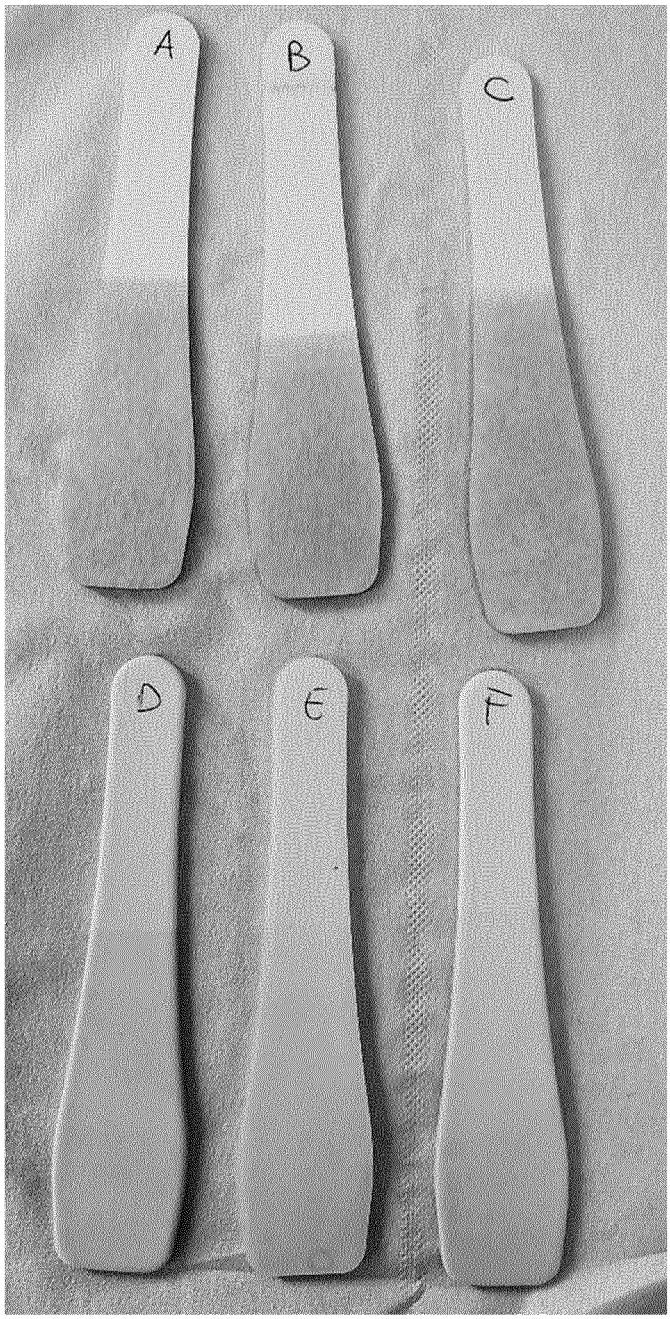
FIG. 8 reproduces a photograph of cardboard stirring sticks obtained according to the prior art (upper part of the picture) and according to the invention (lower part of the picture) after 30 seconds of contact with hot coffee.

Three specimens of the invention and three specimens of the prior art were weighed, immersed in hot coffee (65° C.) for 30 seconds, then extracted and weighed again. The six specimens extracted from hot coffee are shown in FIG. 8: specimens A-C were obtained in Example 4 (prior art), specimens D-F were obtained in Example 5 (invention).

As can be seen in the figure, specimens A-C of the prior art show an evident discoloration in the lower part, that was immersed in coffee, while the discoloration of the specimens D-F of the invention is much less intense (hardly visible in the figure).

In Table 2 are reported the initial ($P_0$) and final ($P_1$) weights and the weight variation ($\Delta P$) of the six specimens; the last column reports the average $\Delta P$ for the specimens of the prior art and of the invention.

TABLE 2

| Specimen | $P_0$ (g) | $P_1$ (g) | $\Delta P$ (g) | Av. $\Delta P$ (g) |
|---|---|---|---|---|
| A | 2.014 | 2.191 | 0.177 | 0.172 |
| B | 2.033 | 2.180 | 0.147 | |
| C | 2.029 | 2.221 | 0.192 | |
| D | 2.025 | 2.056 | 0.031 | 0.030 |
| E | 2.060 | 2.088 | 0.028 | |
| F | 2.037 | 2.069 | 0.032 | |

It is evident from the data in the table above that the paper treated according to JP 2008-50380 A absorbs much more liquid than paper treated according to the present invention.

Example 9

Three primary solutions prepared as described in Example 1 were prepared and mixed, obtaining a first mixture containing:

$SiO_2$: 5%;
TEOS: 35%;
MTES: 35%;
water: 25%.

Ethanol was added to the first mixture thus obtained, in a weight ratio first mixture:EtOH of 6:4.

6 $g/m^2$ of the treatment solution thus obtained were applied with a spray gun on the surface of a cardboard of area weight 210 $g/m^2$.

The treated cardboard was dried in a closed oven at 165° C. for 1 minute.

Figure 9:
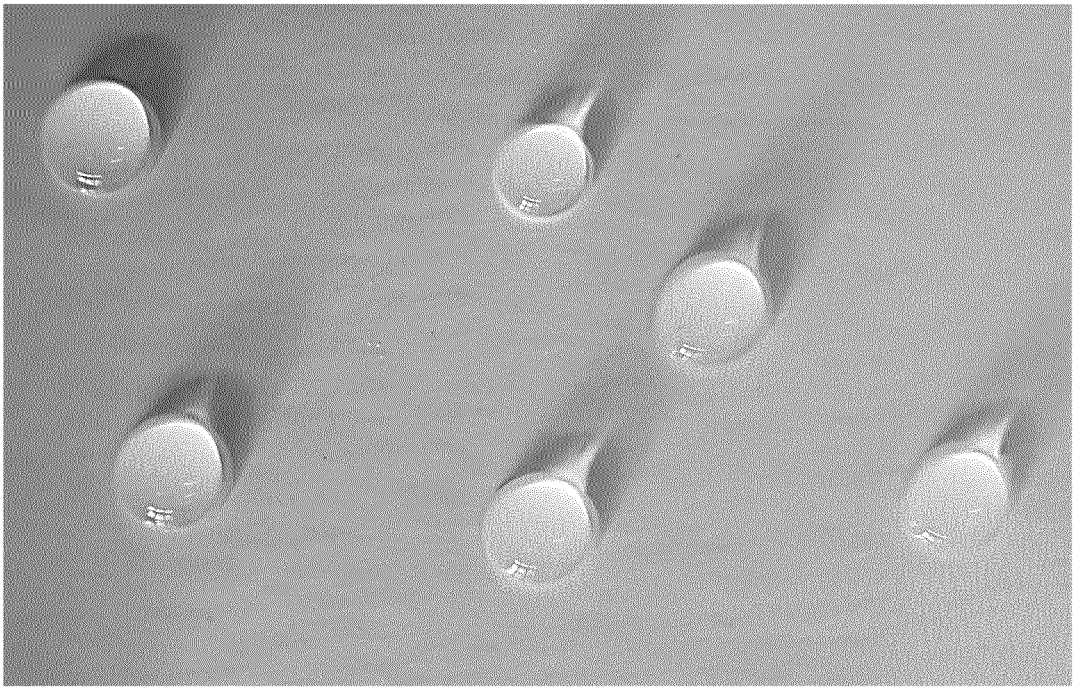
FIGS. 9 and 10 reproduce photographs (at different angles) showing water drops on the surface of cardboard treated with different solutions according to the invention.
Figure 9:
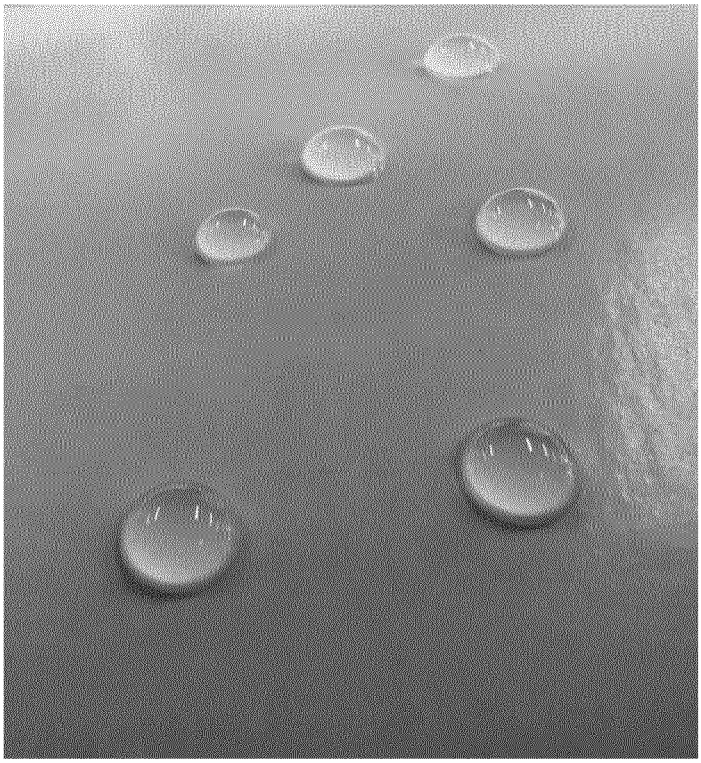

Water was deposited onto the coated cardboard thus obtained, giving rise to the formation of drops on the treated surface; FIG. 9 shows two pictures of the water drop, in two views (top and inclined angle) similar to those in FIG. 5. It is evident from the picture the hydrophobic character of the treated cardboard.

Example 10

Two primary solutions of micrometric silica and TEOS were prepared as described in Example 1. A third primary solution was prepared by adding 725 g of methyl-triethoxysilane (MTES) to 130 g of distilled water, stirring the solution with a mechanical stirrer to make it homogeneous, bringing the pH to 1 with the addition of HCl, then adding 145 g of light blue-dyed glycerine, and allowing the system to react for 8 hours.

The three primary solutions were mixed, obtaining a first mixture containing:

$SiO_2$: 18%;
TEOS: 15%;
MTES: 35%;
water: 25%;
glycerine: 7%.

This solution was applied through a flexo printing machine onto tissue paper of area weight 60 $g/m^2$.

The treated paper was dried in a closed oven at 165° C. for 1 minute.

Figure 10:
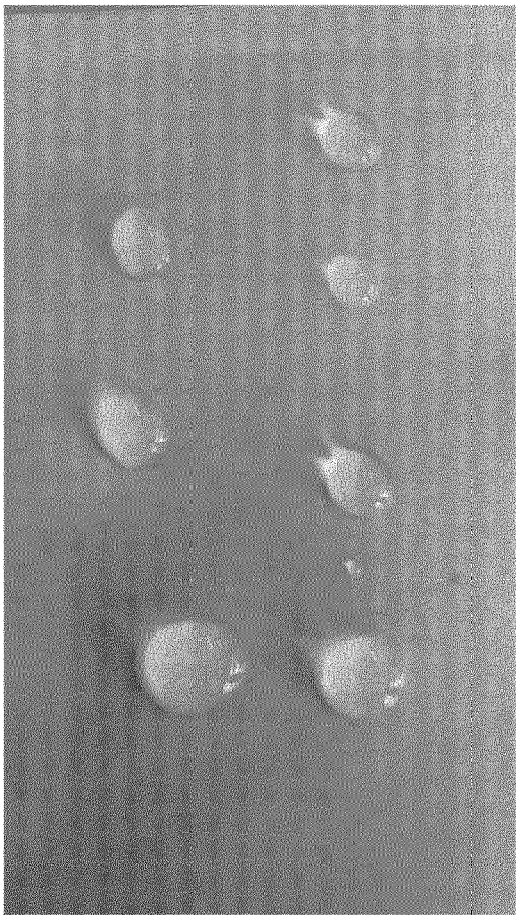
Figure 10:
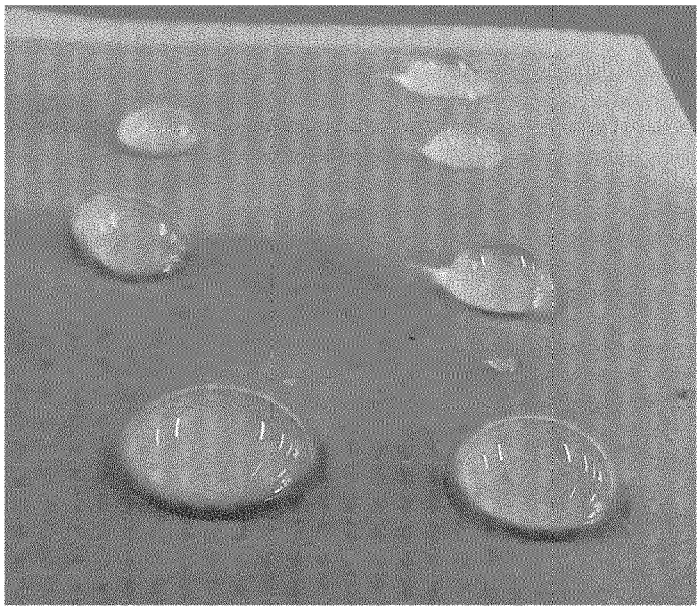

Water was deposited onto the coated paper thus obtained, giving rise to the formation of drops on the treated surface; FIG. 10 shows two pictures of the water drop, in two views (top and inclined angle) similar to those in FIG. 5. It is evident from the picture the hydrophobic character of the treated cardboard.

The invention claimed is:

1. A process for the treatment of paper or cardboard that makes them impermeable to liquids and gases, consisting of:

A) applying to a surface of the paper or cardboard a treatment solution comprising:

a.1) between 35% and 100% by weight of an aqueous solution containing between 5% and 20% by weight of micrometric silica in the form of primary particles of nano-sized silica smaller than 1 μm aggregated to form micrometer-sized secondary particles with size between about 1-100 μm, between 15% and 40% by weight of a hydrolyzed tetraalkoxysilane, and between 25% and 40% by weight of a hydrolyzed alkyl-trialkoxysilane;

and optionally one or more further components selected from:

a.2) between 10% and 50% by weight of a C1-C6 alcohol or a mixture thereof;

a.3) a base selected from NaOH and KOH in such an amount as to control the pH in the range between 2.3 and 4.5; and a.4) between 2% and 15% by weight of glycerin dyed with a coloring agent approved for food use;

B) subjecting the paper or cardboard treated with the treatment solution of step A) to a thermal treatment at a temperature between 10° and 250° C.;

wherein the aqueous solution of point a.1 is obtained by mixing a first primary suspension of micrometric silica in water with a concentration between 10% and 70% by weight, wherein silica purity is not lower than 99.5%;

a second primary solution of a hydrolyzed tetraalkoxysilane in water having a concentration between 10% and 20% by mole, wherein the tetraalkoxysilane general formula before hydrolysis is $Si(OR)_4$, wherein R is a C1-C4 alkyl radical, and wherein the hydrolysis of the tetraalkoxysilane is carried out bringing the solution to a pH value of between 9 and 14; and a third primary solution of a hydrolyzed alkyl-trialkoxysilane in water having a concentration between 30% and 50% by mole, wherein the alkyl-trialkoxysilane general formula before hydrolysis is $R'—Si(OR'')_3$, wherein R' and R'', the same or different from each other, are C1-C4 alkyl radicals, and wherein the hydrolysis of the alkyl-trialkoxysilane is carried out by bringing the solution to a pH value of between 1 and 3.

2. The process according to claim 1, wherein the dyed glycerin of point a.4 is either added to one of the three primary suspensions or solutions used for the preparation of the aqueous solution of point a.1 or is added at the end of the treatment solution preparation.

3. A process for the treatment of paper or cardboard that makes them impermeable to liquids and gases, consisting of:

A) applying to a surface of the paper or cardboard a treatment solution comprising:

a.1) between 35% and 100% by weight of an aqueous solution containing between 5% and 20% by weight of micrometric silica in the form of primary particles of nano-sized silica smaller than 1 μm aggregated to form micrometer-sized secondary particles with size between about 1-100 μm, between 15% and 40% by weight of a hydrolyzed tetraalkoxysilane, and between 25% and 40% by weight of a hydrolyzed alkyl-trialkoxysilane;

and optionally one or more further components selected from:

a.2) between 10% and 50% by weight of a C1-C6 alcohol or a mixture thereof;

a.3) a base selected from NaOH and KOH in such an amount as to control the pH in the range between 2.3 and 4.5; and a.4) between 2% and 15% by weight of glycerin dyed with a coloring agent approved for food use;

B) subjecting the paper or cardboard treated with the treatment solution of step A) to a thermal treatment at a temperature between 10° and 250° C.;

wherein in step B) of the process the paper or cardboard treated with the solution of step A) is subjected to a thermal treatment in one or more ovens at a temperature of between 10° and 250° C.;

wherein said thermal treatment is carried out using a tunnel oven and the paper or cardboard treated with the solution of step A) is guided from one end to the other across the length of the tunnel oven, and wherein the temperature at an inlet section of the oven is lower than the temperature at an outlet section of the oven.

* * * * *